United States Patent [19]

Lonnemo

[11] 4,353,289

[45] Oct. 12, 1982

[54] POWER TRANSMISSION

[75] Inventor: Kurt R. Lonnemo, Bloomfield Hills, Mich.

[73] Assignee: Sperry Corporation, Troy, Mich.

[21] Appl. No.: 154,473

[22] Filed: May 29, 1980

[51] Int. Cl.[3] ..... F15B 11/04

[52] U.S. Cl. ..... 91/420; 91/455; 91/461

[58] Field of Search ..... 91/420, 433, 461, 455

[56] References Cited

U.S. PATENT DOCUMENTS 4,201,052 5/1980 Breeden ..... 91/461 X 4,250,794 2/1981 Haak ..... 91/420

*Primary Examiner*—Robert G. Nilson

*Attorney, Agent, or Firm*—Barnes, Kisselle, Raisch & Choate

[57] ABSTRACT

A hydraulic control system comprising a hydraulic actuator having opposed openings adapted to alternately function as inlets and outlets for moving the element of the actuator in opposite directions, a pump for supplying fluid to said actuator, pilot operated meter-in valve means to which the fluid from the pump is supplied for controlling the direction of movement of the actuator, pilot operated meter-out valve means associated with each opening of the actuator for controlling the flow out of said actuator, and means for sensing a predetermined drop in a line supplying fluid to one opening of the actuator caused by a runaway load in one direction and operating the meter-out valve means to interrupt flow out of the other opening of the actuator.

12 Claims, 3 Drawing Figures

POWER TRANSMISSION

This invention relates to power transmissions and particularly to hydraulic circuits for actuators such as are found on earth moving equipment including excavators.

BACKGROUND AND SUMMARY OF THE INVENTION

In many applications, particularly winch drives and traction drives driven by hydraulic motors, the load may be overrunning and cause the hydraulic motor to exceed maximum allowable speed and/or cavitate resulting in loss of control of the load or a runaway condition.

It is, therefore, desirable to have some form of automatic protection against overspeed. A commom method is employment of a so-called counterbalance valve. Use of such a counterbalance valve also requires use of a relief valve in parallel for over pressure protection. This constitutes a cumbersome and expensive solution, and it is the purpose of this invention to provide a simple and inexpensive circuit for solving the problem of overrunning loads.

In the copending U.S. application Ser. No. 024,058, filed Mar. 26, 1979, now U.S. Pat. No. 4,201,052, and Ser. No. 117,936, filed Feb. 4, 1980 having a common assignee with the present application there is disclosed hydraulic circuits wherein a valve assembly comprising a pilot operated meter-in valve and pilot operated meter-out valve is mounted directly on an actuator.

The present invention is particularly directed to the control of overrunning loads in such a hydraulic circuits.

In accordance with the invention, the pressure in the line supplying fluid to the actuator is sensed and if there is a pressure drop caused by a runaway load the meter-out valve controlling flow out of the actuator is closed thereby controlling the speed of the actuator, preventing cavitation and resultant loss of the load.

DESCRIPTION OF THE DRAWINGS

Referring to FIGS. 1 and 2, the hydraulic system embodying the invention comprises an actuator 20, herein shown as a hydraulic cylinder, having a rod 21 that is moved in opposite directions by hydraulic fluid supplied from a variable displacement pump system 22 which has load sensing control in accordance with conventional construction. The hydraulic system further includes a manually operated controller, not shown, that directs a pilot pressure to a valve system 24 for controlling the direction of movement of the actuator, as presently described. Fluid from the pump 22 is directed to the line 25 and line 26 to a meter-in valve 27 that functions to direct and control the flow of hydraulic fluid to one or the other end of the actuator 20. The meter-in valve 27 is pilot pressure controlled by controller 23 through lines 28, 29 and lines 30, 31 to the opposed ends thereof, as presently described. Depending upon the direction of movement of the valve, hydraulic fluid passes through lines 32, 33 to one or the other end of the actuator 20.

Figure 1:
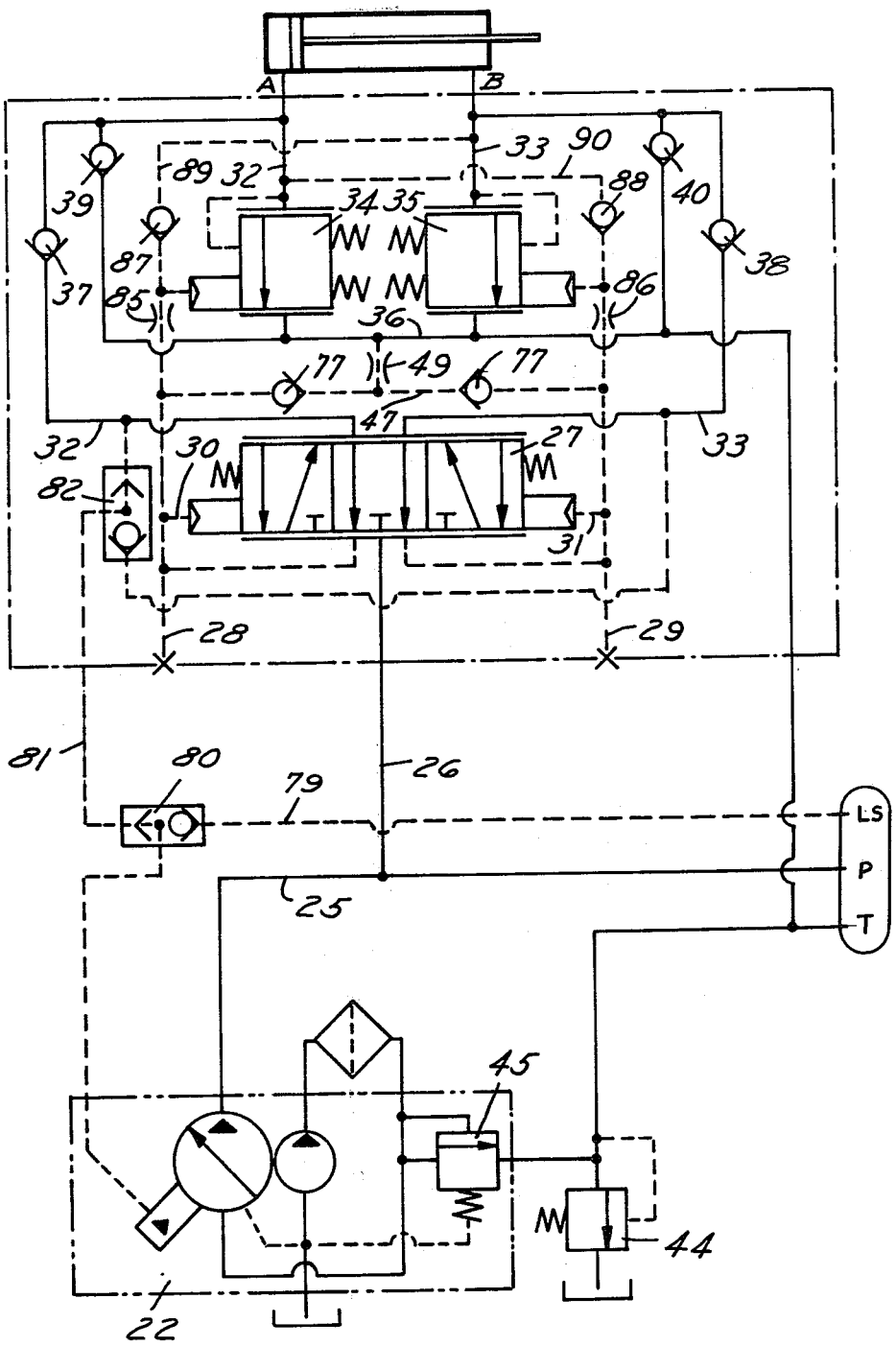
FIG. 1 is a schematic drawing of the hydraulic circuit embodying the invention.

The hydraulic system further includes a meter-out valve 34, 35 associated with each end of the actuator in lines 32, 33 for controlling the flow of fluid from the end of the actuator to which hydraulic fluid is not flowing from the pump to a tank passage 36, as presently described.

The hydraulic system further includes spring loaded poppet valves 37, 38 in the lines 32, 33 and spring loaded anti-cavitation valves 39, 40 which are adapted to open the lines 32, 33 to the tank passage 36. In addition, spring loaded poppet valves, not shown, are associated with each meter-out valves 34, 35. A bleed line 47 having an orifice 49 extends from passage 36 to meter-out valves 34, 35 and to the pilot control lines 28, 29 through check valves 77.

The system also includes a back pressure valve 44 associated with the return or tank line. Back pressure valve 44 functions to minimize cavitation when an overrunning or a lowering load tends to drive the actuator down. A charge pump relief valve 45 is provided to take excess flow above the inlet requirements of the pump 22 and apply it to the back pressure valve 44 to augment the fluid available to the actuator.

Meter-in valve 27 comprises a bore in which a spool is positioned and the absence of pilot pressure maintained in a neutral position by springs. The spool normally blocks the flow from the pressure passage 26 to the passages 32, 33. When pilot pressure is applied to either passage 30 or 31, the meter-in spool is moved in the direction of the pressure until a force balance exists among the pilot pressure, the spring load and the flow forces. The direction of movement determines which of the passages 32, 33 is provided with fluid under pressure from passage 26.

When pilot pressure is applied to either line 28 or 29, leading to meter-out valves 34 or 35, the valve is actuated to vent the associated end of actuator 20 to tank passage 36.

It can thus be seen that the same pilot pressure which functions to determine the direction of opening of the meter-in valve also functions to determine and control the opening of the appropriate meter-out valve so that the fluid in the actuator can return to the tank line.

In the case of an energy absorbing load, when the controller is moved to operate the actuator 20 in a predetermined direction, pilot pressure applied through line 28 and passage 30 moves the spool of the meter-in valve to the right causing hydraulic fluid under pressure to flow through passage 33 opening valve 38 and continuing to the inlet B of actuator 20. The same pilot pressure is applied to the meter-out valve 34 permitting the flow of fluid out of the end of the actuator 20 to the return or tank passage 36.

When the controller is moved to operate the actuator, for example, for an overrunning or lowering a load, the controller is moved so that pilot pressure is applied to the line 28. The meter-out valve 34 opens before the meter-in valve 27 under the influence of pilot pressure. The load on the actuator forces hydraulic fluid through the opening A of the actuator past the meter-out valve 34 to the return or tank passage 36. At the same time, the valve 40 is opened permitting return of some of the fluid to the other end of the actuator through opening B thereby avoiding cavitation. Thus, the fluid is supplied to the other end of the actuator without opening the meter-in valve 27 and without utilizing fluid from the pump.

To achieve a float position, the controller is bypassed and pilot pressure is applied to both pilot pressure lines 28, 29. This is achieved, for example, by a circuit, not shown which will apply the fluid from a pilot pump directly to lines 28, 29 causing both meter-out valves 34 to open and thereby permit both ends of the actuator to be connected to tank pressure. In this situation, the meter-out valves function in a manner permitting fluid to flow back and forth between opposed ends of the cylinder.

Where the pressure in the return from end A of the actuator is excessive, the pilot spool of valve 41 functions to permit the poppet valve of meter-out valve 34 to open and thereby compensate for the increased pressure as well as permit additional flow to the actuator 20 through opening of the poppet valve 40 extending to the passage which extends to the other end of the actuator.

By varying the spring forces and the areas on the meter-in valve 27 and the meter-out valves 34, 35, the timing between these valves can be controlled. Thus, for example, if the timing is adjusted so that the meter-out valve leads the meter-in valve, the meter-in valve will control flow and speed in the case where the actuator is being driven. In such an arrangement with an overhauling load, the load-generated pressure will result in the meter-out valve controlling flow and speed. In such a situation, the anti-cavitation check valves 39, 40 will permit fluid to flow to the supply side of the actuator so that no pump flow is needed to fill the actuator in an overhauling load mode or condition.

A check valve 77 is provided in a branch of each pilot line 28, 29 adjacent each meter-out valve 34, 35. The valves 77 allow fluid to bleed from the high tank pressure in passage 36, which fluid is relatively warm, and to circulate through pilot lines 28, 29 back to the controller and the fluid reservoir when no pilot pressure is applied to the pilot lines 28, 29. When pilot pressure is applied to a pilot line, the respective check valve 77 closes isolating the pilot pressure from the tank pressure.

Provision is made for sensing the maximum load pressure in one of a series of valve systems 24 controlling a plurality of actuators and applying that higher pressure to the load sensitive variable displacement pump 22. Each valve system 24 includes a line 79 extending to a shuttle valve 80 that receives load pressure from an adjacent actuator through line 81. Shuttle valve 80 senses which of the two pressures is greater and shifts to apply the same to a shuttle valve 82 through line 83. A line 84 extends from passage 32 to shuttle valve 82. Shuttle valve 82 senses which of the pressures is greater and shifts to apply the higher pressure to pump 22. Thus, each valve system in succession incorporates shuttle valves 80, 82 which compare the load pressure therein with the load pressure of an adjacent valve system and transmit the higher pressure to the adjacent valve system in succession and finally apply the highest load pressure to pump 22.

The above described circuit is shown and described in the aforementioned United States applications Ser. No. 024,058, now U.S. Pat. No. 4,201,052 and 117,936. The single meter-in valve 27 may be replaced by two meter-in valves as described in the aforementioned application Ser. No. 117,936.

The details of the preferred construction of the elements of the hydraulic circuit are more specifically described in the aforementioned United States applications Ser. No. 024,058, now U.S. Pat. No. 4,201,052, and Ser. No. 117,936 which are incorporated herein by reference.

In accordance with the invention in order to insure overspeed protection, restrictions 85, 86 are provided in pilot lines 28, 29, which extend to pilot operated meter-out valves 34, 35, respectively. In addition, check or relief valves 87, 88 are provided in lines 89, 90 that extend to the lines 33, 32 respectively.

Referring, for example, to orifice 85 and check valve 87, there is no flow from line 28 to line 33 as long as the pressure in line 33 exceeds maximum control pressure, i.e. 300 psi. If the conduit 33 pressure becomes lower as when the load is overrunning, a flow will take place and create a pressure drop across orifice 85. If the conduit pressure falls below the pilot control pressure, i.e. 200 psi, the control pressure downstream of the orifice 85, i.e., meter-out control pressure, will also fall below 200 psi and, thereby, start to close the meter-out valve 34. This will effectively prevent actuator cavitation and resultant runaway.

If a spring is added to the check valves 87, 88, the triggering pressure level can be changed downwards. Rotary motors typically would not require such springs.

Thus the restrictions 85, 86 and check valves 87, 88 function to sense a drop in pressure applied to the actuator and function to close the meter-out valve which is controlling the flow of fluid out of the actuator when the pressure drops below a predetermined value related to the pilot pressure.

Where the actuator is associated with equipment where overrunning can occur in only one direction, then only one set of a restriction and check valve need be used, the restriction sensing the drop in pressure in the end of the actuator to which pump pressure is being applied.

Figure 2:
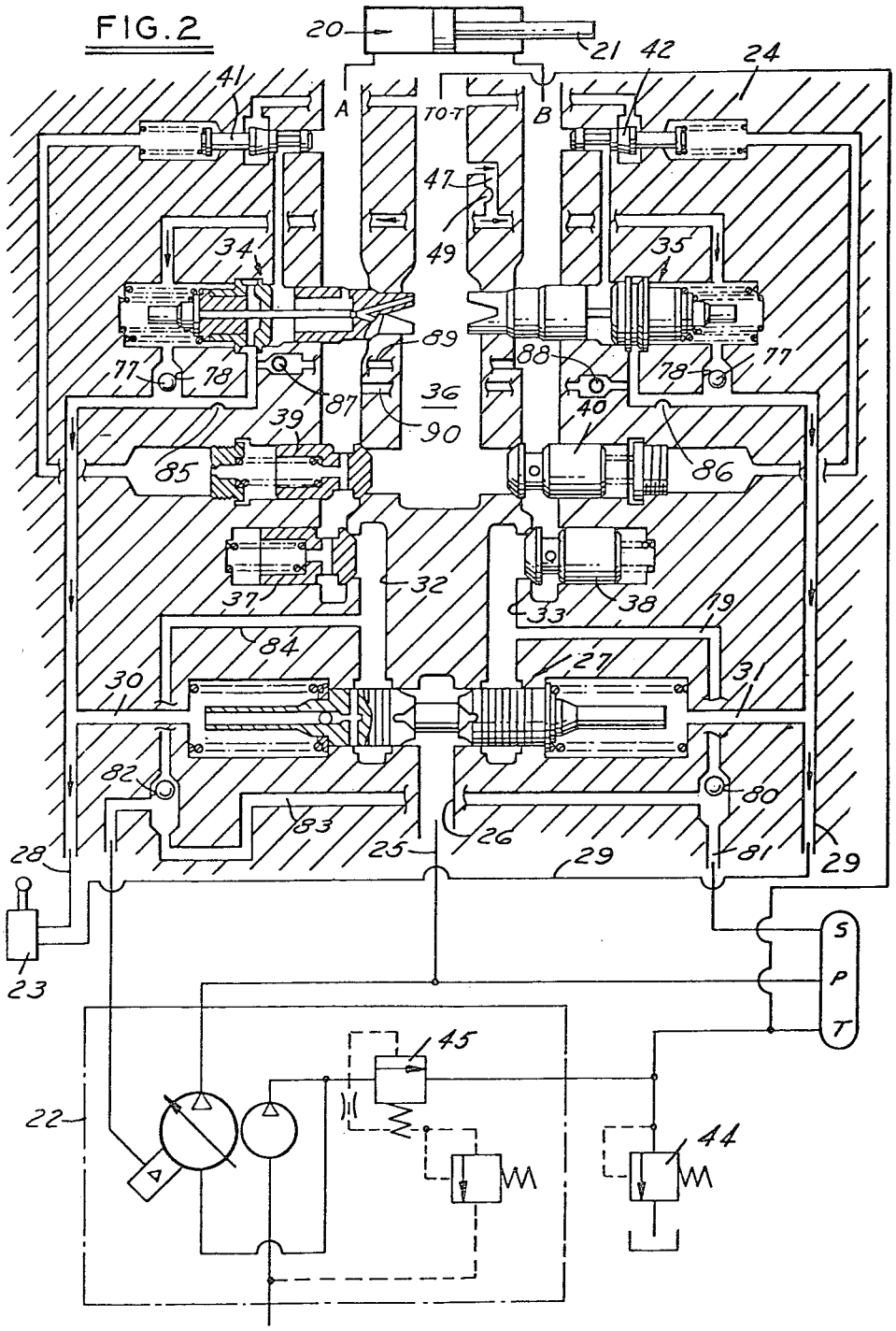
FIG. 2 is a partly diagrammatic view of a hydraulic circuit embodying the invention.

In practice, as shown in FIG. 2 the various components of valve assembly 24 are preferably made as a part of a valve which is mounted directly on actuator 20 so that the need for long flow lines from the valve assembly to the actuator is obviated.

As can be seen, the various components of valve assembly are provided in a body adapted to be mounted on the actuator. For clarity, corresponding reference numerals have been used and controller 23 is shown.

Figure 3:
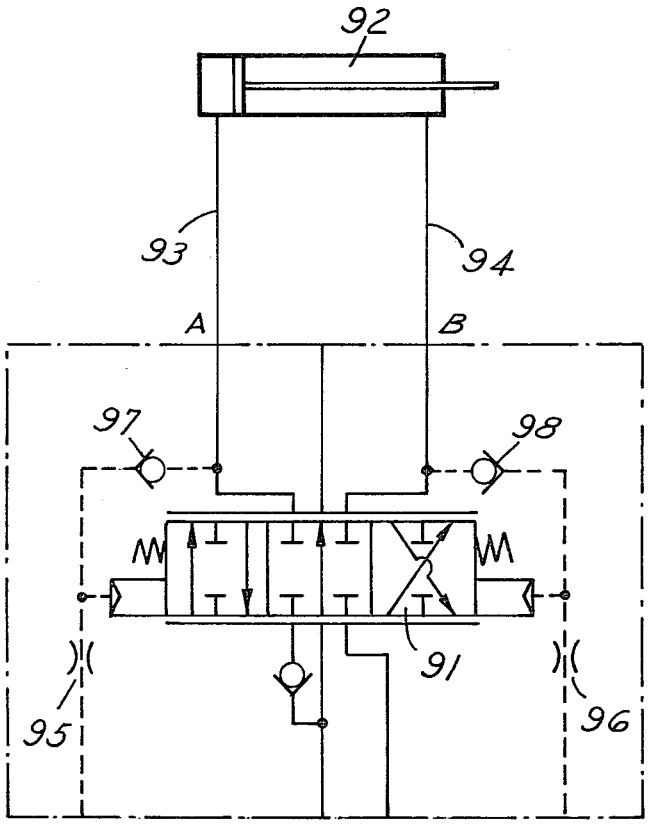
FIG. 3 is a schematic drawing of a modified hydraulic circuit.

Referring to FIG. 3, the invention is also applicable to a conventional hydraulic circuit wherein a pilot operated directional control valve 91 controls both flow into and out actuator 92 through lines 93, 94. As in the previous form of the invention, restrictions 95, 96 and check valves 97, 98 are provided in pilot lines to sense drops in pressure to the actuator and actuate directional control valve 91 to close flow out of the actuator 92 when the load on the actuator tends to runaway.

I claim:

1. A hydraulic control system comprising a hydraulic actuator having opposed openings adapted to alternately function as inlets and outlets for moving the element of the actuator in opposite directions, a pump for supplying fluid to said actuator, meter-in valve means to which the fluid from the pump is supplied, said meter-in valve means being pilot controlled by alternately supplying fluid at pilot pressure to said meter-in valve means for controlling the direction of movement of the actuator, a pair of lines extending from said meter-in valve means to said respective openings of said actuator, meter-out valve means associated with each opening of the actuator for controlling the flow out of said actuator, said meter-out valve means being pilot operated by the pilot pressure, and means for sensing a predetermined drop in pressure in the line supplying fluid to one opening of said actuator caused by a runaway load in one direction and operating said meter-out valve means to meter flow out of the other opening of said actuator, said last-mentioned sensing and operating means comprising a restriction in the pilot line actuating the meter-out valve means for controlling flow out of the other opening of said actuator, a sensing line extending from said pilot line to said line supplying pump pressure to said one opening of said actuator and a check valve in said sensing line.

2. The hydraulic system set forth in claim 1 including second means for sensing a predetermined drop in pressure in the line supplying fluid to the other opening of said actuator caused by an overrunning load in the opposite direction and operating said meter-out valve means to interrupt flow out of the one opening of the actuator.

3. The hydraulic system set forth in claim 1 wherein said meter-out valve means comprises separate pilot operated valves.

4. The hydraulic system set forth in claim 3 including a check valve in each said line operable to permit fluid to flow from the meter-in valve to the actuator when the pressure exceeds a predetermined value.

5. The hydraulic system set forth in claim 3 including an anti-cavitation valve in each said line to said actuator operable to pass fluid from the tank to said line when the pressure exceeds a predetermined value.

6. The hydraulic system set forth in claim 1 wherein said meter-in valve means and meter-out valves are mounted in close proximity to the actuator.

7. The hydraulic system set forth in claim 1 wherein said meter-in valve means and said meter-out valves are mounted on said actuator.

8. A hydraulic control system comprising a hydraulic actuator having opposed openings adapted to alternately function as inlets and outlets for moving the element of the actuator in opposite directions, a variable displacement pump for supplying fluid to said actuator, meter-in valve means to which the fluid from the pump is supplied, said meter-in valve means being pilot controlled by alternately supplying fluid at pilot pressure to said meter-in valve means for controlling the direction of movement of the actuator, a pair of lines extending from said meter-in valve means to said respective openings of said actuator, a spring-loaded poppet valve in each of said lines, meter-out valve means associated with each opening of the actuator for controlling the flow out of said actuator, said meter-out valve means being pilot operated by the pilot pressure, and means for sensing a predetermined drop in pressure in the line supplying fluid to one opening of said actuator caused by a runaway load in one direction and operating said meter-out valve means to meter flow out of the other opening of said actuator, said last-mentioned sensing and operating means comprising a restriction in the pilot line actuating the meter-out valve means for controlling flow out of the other opening of said actuator, a sensing line extending from said pilot line to said line supplying pump pressure to said one opening of said actuator and a check valve in said sensing line.

9. The hydraulic system set forth in claim 8 including second means for sensing a predetermined drop in pressure in the line supplying fluid to the other opening of said actuator caused by an overrunning load in the opposite direction and operating said meter-out valve means to meter flow out of the one opening of the actuator.

10. The hydraulic system set forth in claim 8 wherein said meter-out valve means comprises separate pilot operated valves.

11. The hydraulic system set forth in claim 10 including a check valve in each said line operable to permit fluid to flow from the meter-in valve to the actuator when the pressure exceeds a predetermined value.

12. The hydraulic system set forth in claim 10 including an anti-cavitation valve in each said line to said actuator operable to pass fluid from the tank to said line when the pressure exceeds a predetermined value.

* * * * *